US006026716A

United States Patent [19]

Orlosky

[11] Patent Number: 6,026,716

[45] **Date of Patent: *Feb. 22, 2000**

[54] SUPERGRIP PLIER-WRENCH TOOL

[75] Inventor: Henry Orlosky, Cameron Park, Calif.

[73] Assignee: Tool Research Corporation, El Dorado Hills, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,686

[22] Filed: May 19, 1997

[51] Int. Cl.[7] ..... B25B 7/12

[52] U.S. Cl. ..... 81/360; 81/322

[58] Field of Search ..... 81/319, 322, 360

[56] References Cited

U.S. PATENT DOCUMENTS

D. 358,746 5/1995 Neff .
3,283,624 11/1966 Neff ..... 81/360
5,176,049 1/1993 Neff .
5,385,072 1/1995 Neff .
5,408,904 4/1995 Neff .

FOREIGN PATENT DOCUMENTS 1094703 12/1954 France ..... 81/360

*Primary Examiner*—James G. Smith
*Attorney, Agent, or Firm*—John P. O'Banion

[57] ABSTRACT

A hand tool that is self-adjusting by alternately squeezing and relaxing the hand grip on the two handles; that has substantially parallel jaws during closing adjustment; that actually grips the work object with at least an 8-to-1 compound gripping leverage; and that can be locked onto an object when desired with a selectively light or strong grip. All of the operations, except the resetting the adjustable jaw to a wide open position, can be done with just the hand holding the tool and it can be made in the form of an adjustable plier, an adjustable wrench, or an adjustable pipe wrench, plus many other applications.

20 Claims, 9 Drawing Sheets

SUPERGRIP PLIER-WRENCH TOOL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to hand tools in general, and more particularly to a tool that grips a work object, is self-adjusting, can be locked on the work object easily and quickly, and can be released from the locked position just as easily and quickly.

2. Description of the Background Art

This invention is an improvement over the hand tool described in U.S. Pat. No. 5,408,904 issued on Apr. 25, 1995 "QUICK-ADJUSTABLE AND LOCKING TOOL", incorporated herein by reference, and the hand tool described in U.S. Pat. No. 5,176,049 issued on Jan. 5, 1993 "COMPOUND LEVERAGE GRIPPING TOOL WITH CONSTANT PARALLEL JAWS", also incorporated herein by reference, both of which are owned by the assignee hereof.

BRIEF SUMMARY OF THE INVENTION

The present invention generally comprises a hand-held tool for gripping a work object that is self-adjusting, can be gripped locked on a work object easily and quickly, and can be released from the gripping and locked position just as easily and quickly. By way of example, and not of limitation, the invention comprises a body with an integral fixed jaw extending from one end and an integral fixed handle extending from the opposite end, a jaw adjusting handle pivotally coupled to the body, and an adjustable jaw slidably and pivotally coupled to the body. Both the adjustable jaw and the jaw adjusting handle carry gear teeth that are normally maintained in engagement under the tension of a spring. The gear teeth, which are of a conjugate involute design, are positioned such that the gripping surfaces of the jaws are maintained in a substantially parallel orientation when the adjustable jaw moves toward the fixed jaw and, in particular, the gear teeth on the adjustable jaw are positioned along an axis that is canted by approximately one to four degrees in relation to a line perpendicular to the axis along the gripping surface of the adjustable jaw. As the jaw adjusting handle is pivoted toward the fixed handle, a jacking action quickly adjusts the adjustable jaw toward the fixed jaw for gripping an object. In order to open the jaws, the user can grasp the lower portion of adjustable jaw and pull it outward from the body to disengage the gears and then away from the fixed jaw in a single motion. In an embodiment configured as pliers, each jaw carries a set of teeth which, instead of directly opposing each other, are laterally offset to reduce the likelihood of the teeth cutting into the object being gripped. Alternative embodiments include jaws with smooth gripping surfaces, jaws with arcuate teeth for gripping cylindrical objects, and jaws with V-shaped gripping surfaces.

An object of the invention is to provide a hand-operated tool for gripping objects that is adjustable.

Another object of the invention is to provide a hand-operated tool for gripping objects that has jaws that maintain substantially parallel alignment while being closed.

Another object of the invention is to provide a hand operated tool for gripping objects that has an adjustable jaw that will close and lock against an object.

Another object of the invention is to provide a hand-operated tool for gripping objects that has locking jaws that can be easily opened for removal of the tool from an object being gripped.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings, which are for illustrative purposes only.

DETAILED DESCRIPTION OF THE INVENTION

Figure 1:
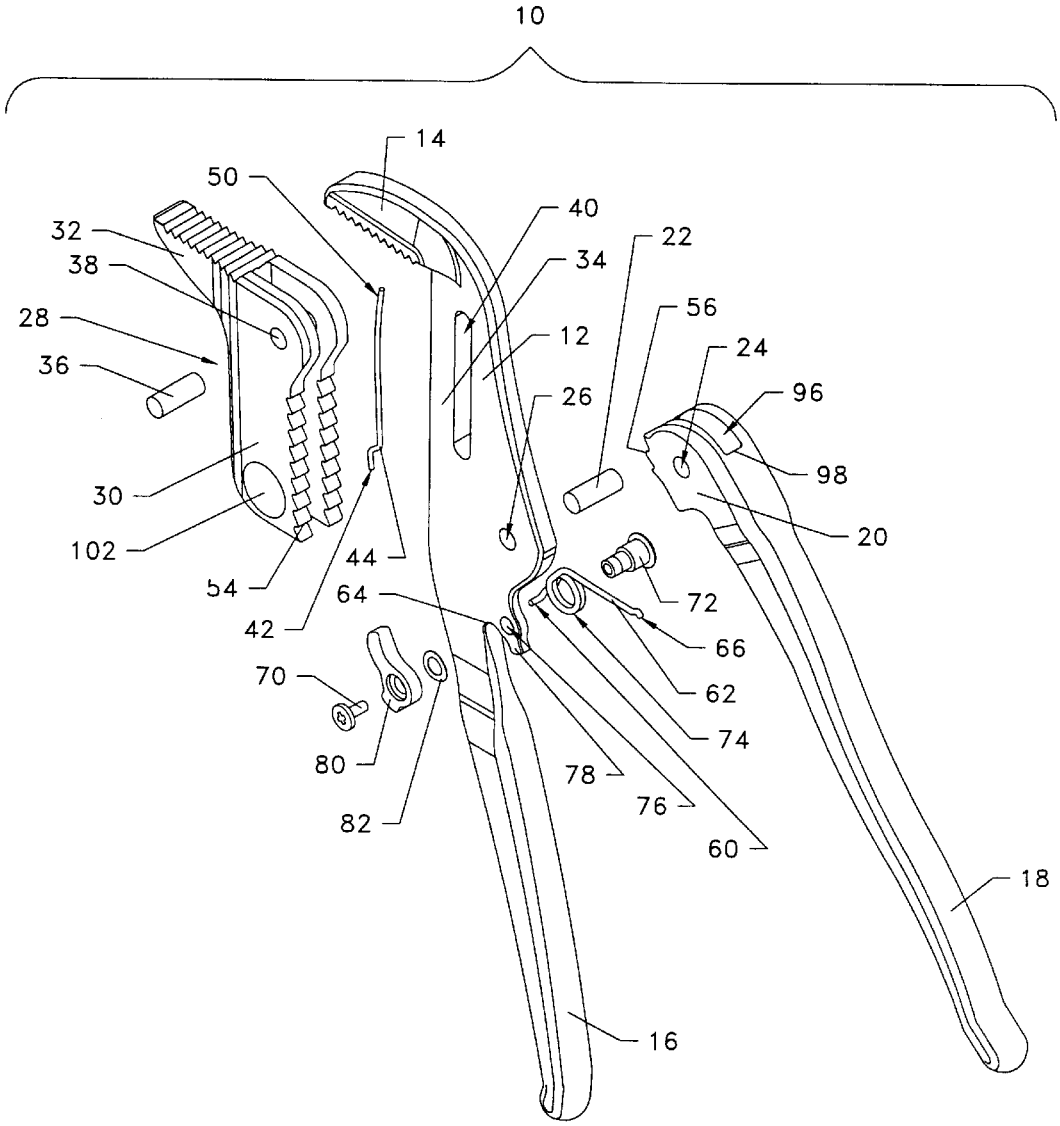
FIG. 1 is an exploded view of an apparatus in accordance with the present invention, shown in the form of a plier having gripping surfaces with serrated teeth.

Referring more specifically to the drawings, for illustrative purposes the present invention is embodied in the apparatus generally shown in FIG. 1 through FIG. 9, where like reference numerals denote like parts. It will be appreciated that the apparatus may vary as to configuration and as to details of the parts without departing from the basic concepts as disclosed herein.

Referring first to FIG. 1, a SuperGrip Plier-Wrench tool 10 in accordance with the present invention is generally shown. The apparatus includes a body 12 with an integral fixed jaw 14 extending from one end, and an integral fixed handle 16 extending from the other end with the longitudinal axis of fixed handle 16 being offset by approximately 0 degrees to 45-degrees from a perpendicular orientation relative to the longitudinal axis of fixed jaw 14.

The apparatus also includes a jaw adjusting handle 18 that is pivotally coupled to body 12. Extending from the distal end of jaw adjusting handle 18 is an integral bifurcated coupling 20 that straddles body 12. A pin 22 or like fastener extends through holes 24 in the sides of coupling 20 and a hole 26 in body 12 for connecting jaw adjusting handle 18 to body 12. It will be appreciated that, in the configuration shown, the diameter of hole 26 must be slightly larger than that of pin 22 to allow for free pivotal movement of jaw adjusting handle 18, while holes 24 in coupling 20 must be sized to provide for tight frictional engagement of pin 22.

An adjustable jaw 28 is slidably and pivotally coupled to body 12. Adjustable jaw 28 generally comprises an integral bifurcated coupling section 30 extending from jaw section 32. The bifurcated coupling section 30 straddles a rail section 34 on body 12 and is coupled to body 12 using a pin 36 or like fastener. Pin 36 extends through holes 38 in the side walls of coupling section 30 and an elongated slot 40 in body 12 to allow for both pivotal and sliding motion of adjustable jaw 28. Note that the rail section 34 is substantially perpendicular to fixed jaw 14 and elongated slot 40 is substantially parallel to rail section 34.

Figure 2:
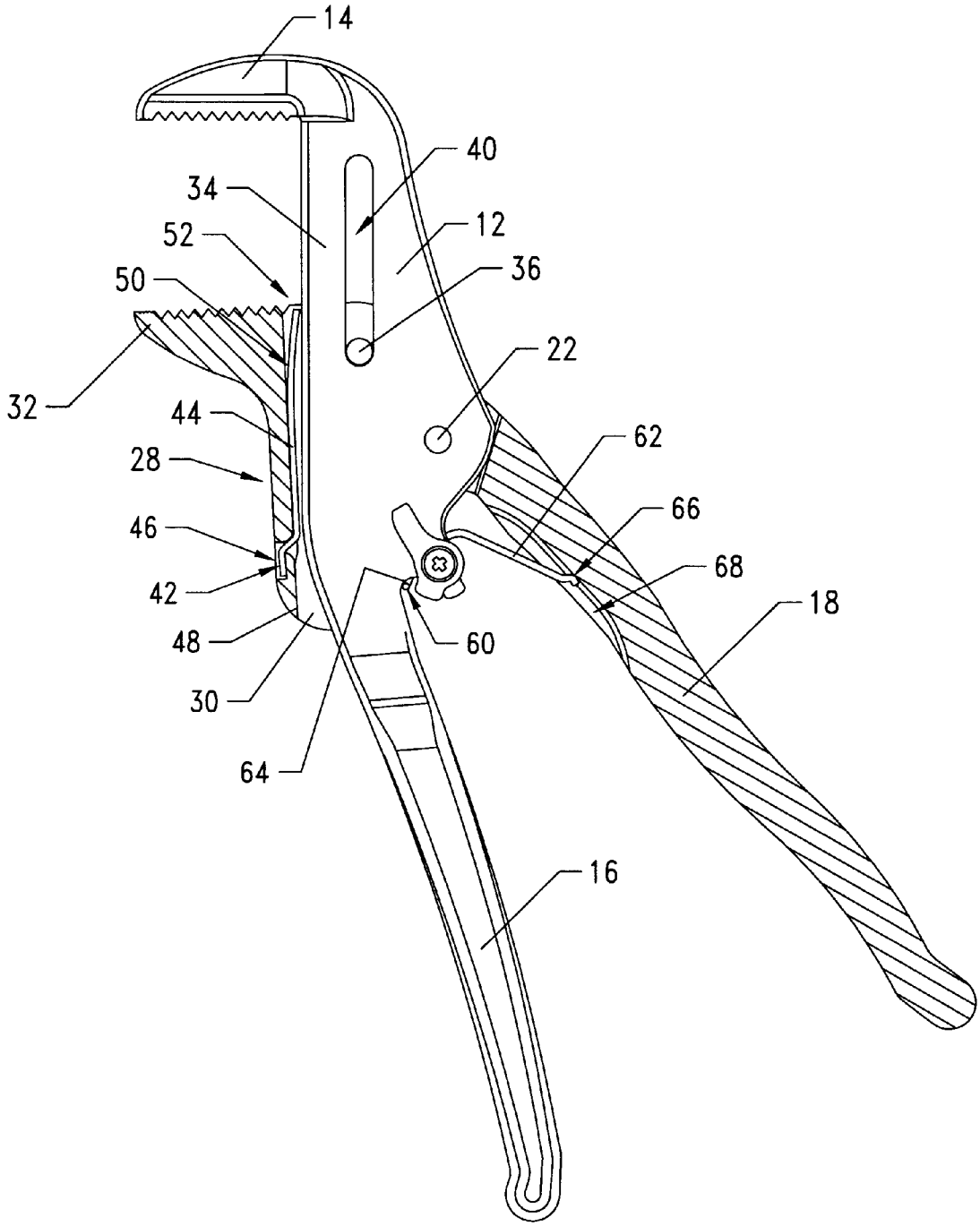
FIG. 2 is assembled side elevation sectional view of the apparatus shown in FIG. 1 with the jaws shown in the fully open position.
Figure 3:
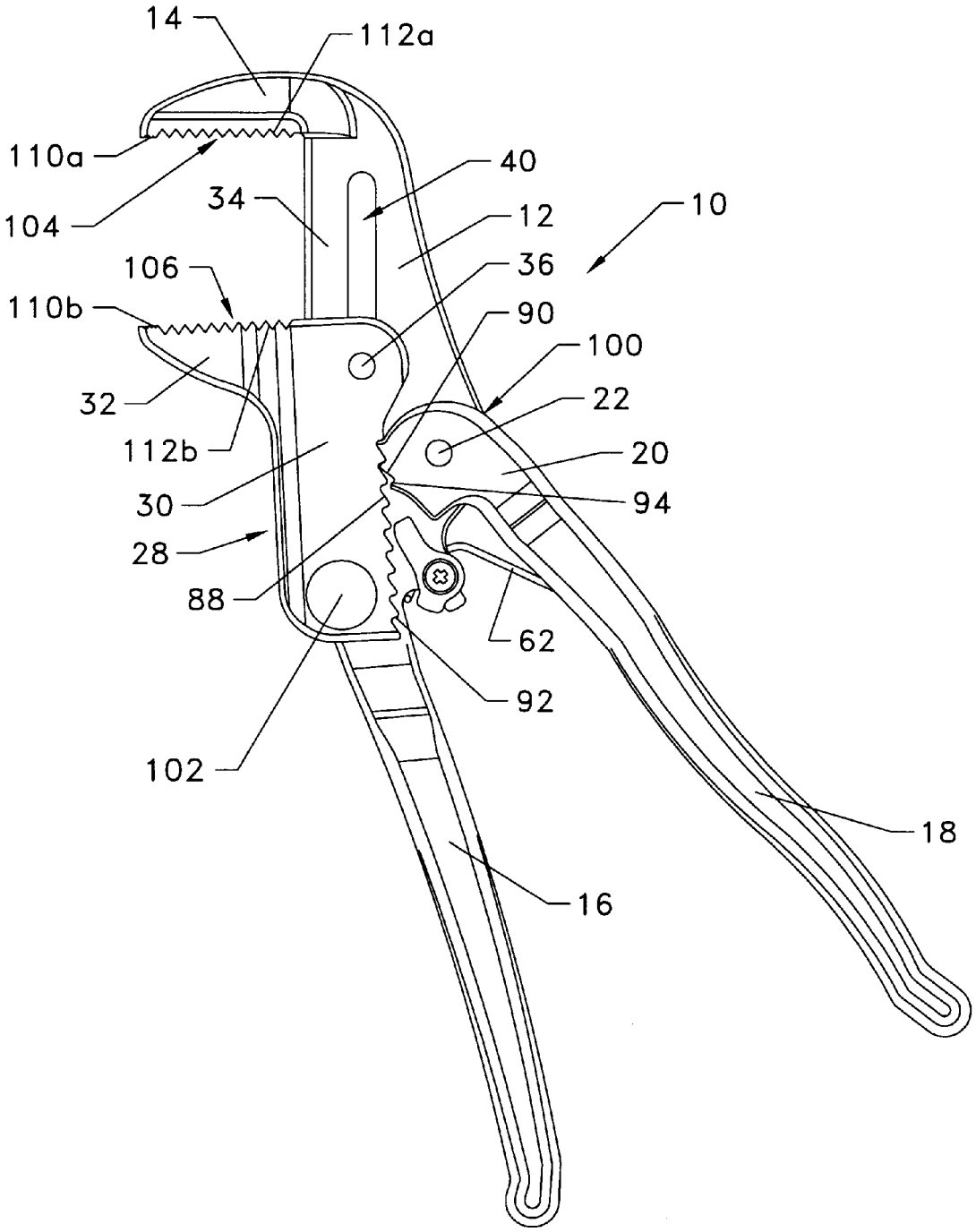
FIG. 3 is an assembled side elevation view of the apparatus shown in FIG. 1 with the jaws shown in the fully open position.
Figure 4:
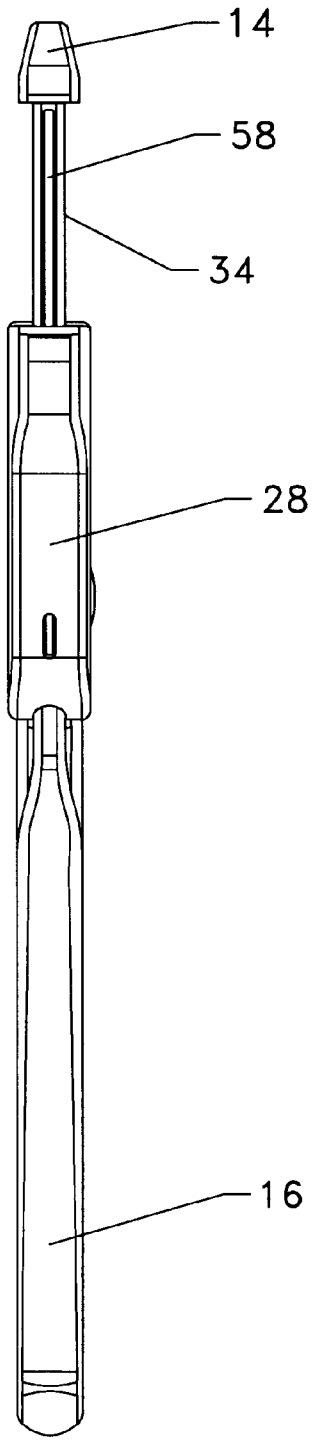
FIG. 4 is an assembled front view of the apparatus shown in FIG. 1 with the jaws shown in the fully open position.

Referring also to FIG. 2, the lower end 42 of a jaw tensioning spring 44 extends into a retention recess 46 in wall 48 of coupling section 30 on adjustable jaw 28. Jaw tensioning spring 44 includes an arcuate upper end 50 that bears forcefully against rail section 34, pushing the upper portion 52 of adjustable jaw 28 away from rail section 34. Referring also to FIG. 3, jaw tensioning spring 44 pushes gear teeth 54 on adjustable jaw 28 toward gear teeth 56 on jaw adjusting handle 18 so that gear teeth are normally engaged. Jaw tensioning spring 44 also holds adjustable jaw member 28 in position by frictional contact with rail section 34 until moved by pivoting motion ofjaw adjusting handle 18 or until adjustable jaw 28 is pulled away from rail section 34 for repositioning away from fixed jaw 14 as described below. Referring also to FIG. 4, if desired the upper end 50 of jaw tensioning spring 44 can optionally fit into a central groove 58 in the face of rail section 34 so as to keep jaw tensioning spring 44 centered.

Referring again to FIG. 1 and FIG. 2, a first end 60 of a handle return spring 62 fits into and rests against an inner shoulder 64 between body 12 and fixed handle 16. A second end 66 of handle return spring 62 fits into recess 68 in jaw adjusting handle 18. Handle return spring 62 also coupled to body 12 using a screw 70 that engages a threaded bushing 72 that extends through coil 74 in handle return spring 62 and hole 76 in yoke 78 that extends from body 12. A handle locking lever 80 and spring washer 82 are also positioned between screw 70 and yoke 78 as shown.

Figure 5:
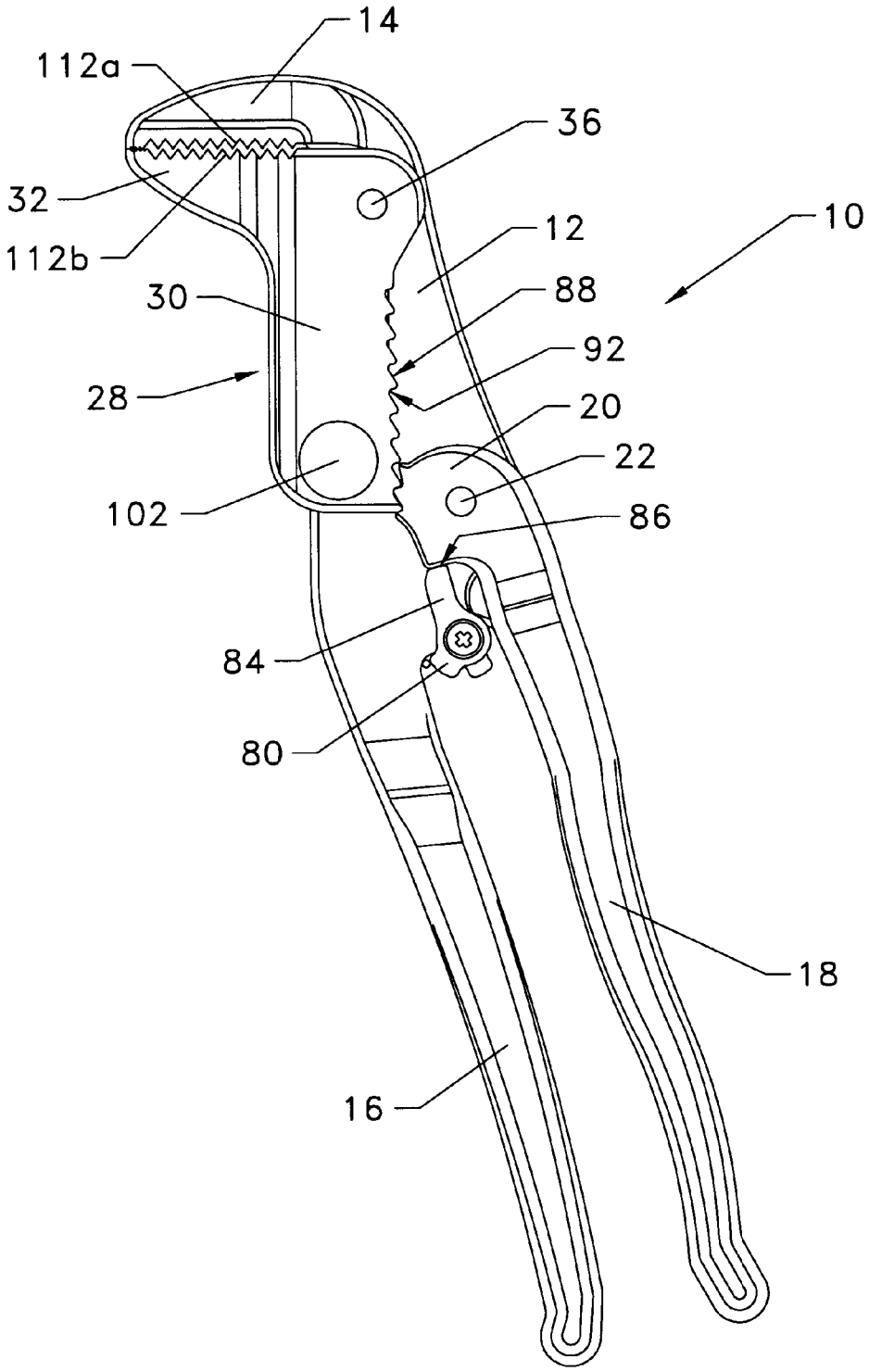
FIG. 5 is an assembled side elevation view of the apparatus shown in FIG. 1 with the jaws shown in the fully closed position and the handles locked.

It will be appreciated that handle locking lever 80 is pivotally coupled to yoke 78 on body 12 as described above. When fixed handle 16 and jaw adjusting handle 18 are in their fully compressed (closed) position as shown in FIG. 5, handle locking lever 80 can be pivoted into a position where a tab 84 that extends from handle locking lever 80 rests against shoulder portion 86 on one side of bifurcated coupling 20. In this position, handle locking lever 80 prevents jaw adjusting handle 18 from pivoting into an open position.

Referring to FIG. 1, FIG. 3 and FIG. 5, ajacking action that quickly adjusts jaw 32 toward jaw 14 is accomplished by the conjugate involute design of gear teeth 54 on adjustable jaw 28 and gear teeth 56 on jaw adjusting handle 18. Both sets of gear teeth have long flat sides 88, 90, and shorter flat sides 92, 94 that join together at radiused edges to form angled teeth. As jaw adjusting handle 18 pivots away from fixed handle 16, the long flat sides 88 on gear teeth 54 slide down the long flat sides 90 and over the radiused edges on gear teeth 56 while adjustable jaw 28 is held substantially stationary by the friction of jaw tensioning spring 44 against rail section 34 until gear teeth 54 and 56 are re-engaged at a lower position on adjustable jaw 28. The pivoting of jaw adjusting handle 18 back toward fixed handle 16 brings short sides 92, 94 into contact and, because of their relatively obtuse angle in relation to rail section 34, they remain engaged until the movement of jaw adjusting handle 18 is again reversed, thereby moving adjustable jaw 28 toward fixed jaw 14 in a series of jacking movements. Repeated pivoting of jaw adjusting handle 18 will close jaws 14 and 32 on an object very quickly in just a few seconds. Alternatively, adjustable jaw 28 can be grasped by the user and slid toward fixed jaw 14 to initially grip the work object, and jaw adjusting handle 28 then used to tighten the grip. The travel of jaw adjusting handle 18 away from fixed handle 16 is limited by the depth of the bifurcation 96 in coupling 20 which terminates in a shoulder 98 that will abut against the edge 100 of body 12 in the fully opened position. Limiting the degree of rotation of jaw adjusting handle 18 prevents the handle from pulling handle return spring 62 apart and facilitates gripping by ensuring that the handle does not open too wide.

To reset jaw 32 to an open position in relation to fixed jaw 14, concave finger grips 102 are provided on each side of adjustable jaw 28 so that the user can easily grasp the lower portion of adjustable jaw 28 and pull it outward and downward in a single motion. This will result in gear teeth 54 and 56 being disengaged and, while disengaged, adjustable jaw 28 may be set at any point between the top and bottom of its travel within the confines of elongated slot 40 and re-engaged at the option of the user.

Figure 6:
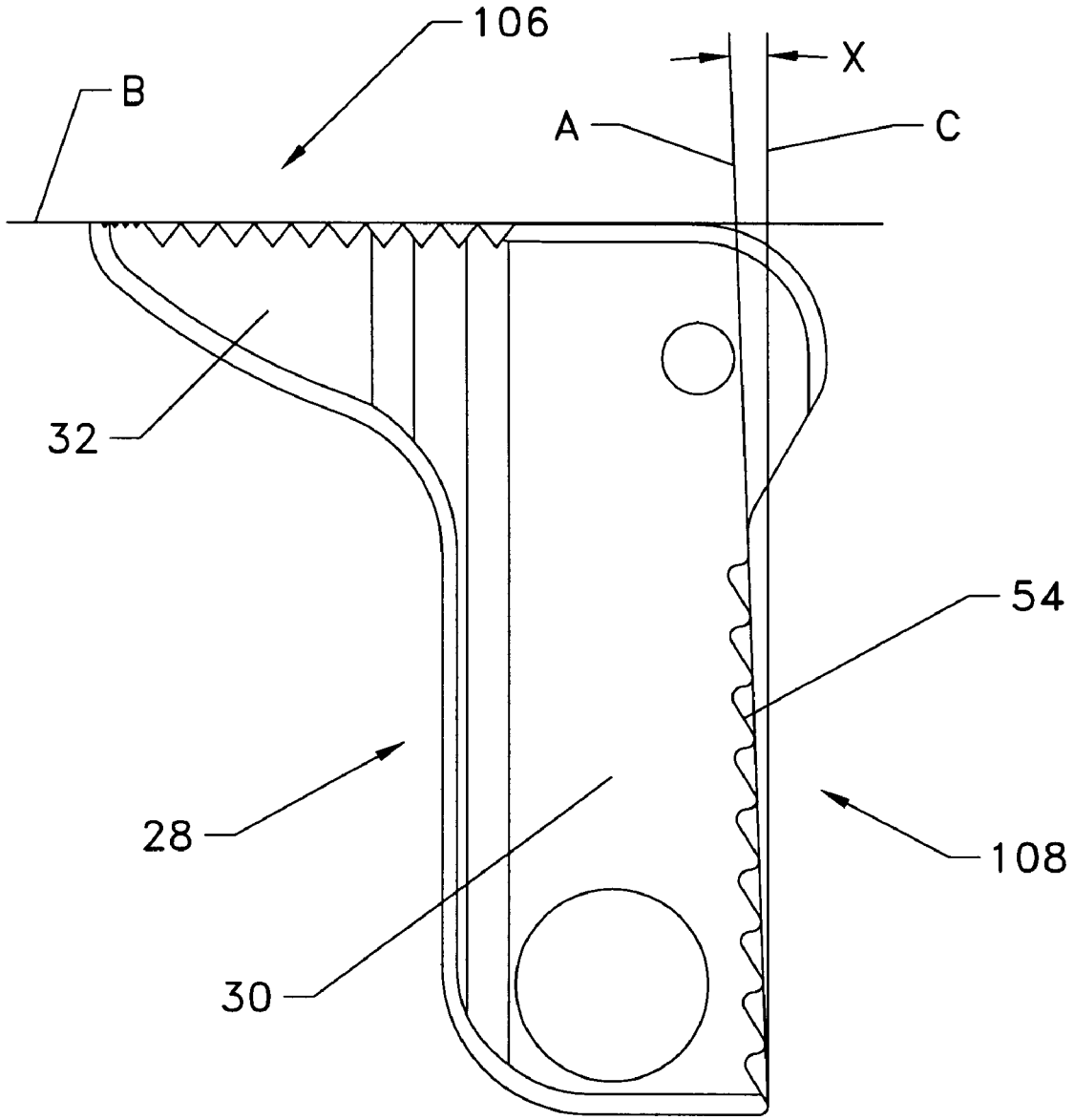
FIG. 6 is a side elevation view of the adjustable jaw portion of the apparatus shown in FIG. 1 illustrating the positional relationship between the gear teeth and the gripping surface of the jaw.

Referring now to FIG. 3 and FIG. 6, it can be seen that jaws 14 and 32 each have longitudinal gripping surfaces 104 and 106, respectively. It is important that, when the jaws are being adjusted toward each other as well as tightened against an object to be gripped, the longitudinal axis along those gripping surfaces are maintained in a substantially parallel orientation. In order to maintain such an orientation while the jaws are being closed and to facilitate a quick closing motion of adjustable jaw 28 from any retracted position, a critical aspect of the invention is the positioning of the conjugate involute gear teeth 54 on adjustable jaw 28. As can be seen from FIG. 6, the longitudinal axis A along gear tooth surface 108 is not perpendicular to the longitudinal axis B along the gripping surface 106 of adjustable jaw assembly 28. Instead, the two axes are offset by an angle X relative to a line C that would be perpendicular to axis B, where angle X is preferably between approximately one and approximately four degrees. In this way, gear teeth 54 are canted inward toward jaw 32 and offset from the gripping surface by approximately eighty-six to eighty-nine degrees instead of ninety degrees.

Referring to FIG. 3 and FIG. 5, gripping surfaces 104 and 106 are shown as including two sets of teeth as gripping members, a set of small teeth 110*a*, 110*b* and a set of large teeth 112*a*, 112*b*, similar to conventional pliers. Referring specifically to FIG. 5, however, note that the teeth 112*a* on jaw 14 do not directly oppose the teeth 112*b* on jaw 32. Instead, teeth 112*b* are laterally offset by an amount equal to approximately thirty percent of the distance between adjacent teeth 112*a*. As a result, when an object is gripped by jaws 14 and 32 it is less likely that teeth 112*a*, 112*b* will cut into the object. Instead, the object may simply undergo slight deformation in the area of contact with the teeth.

Figure 7:
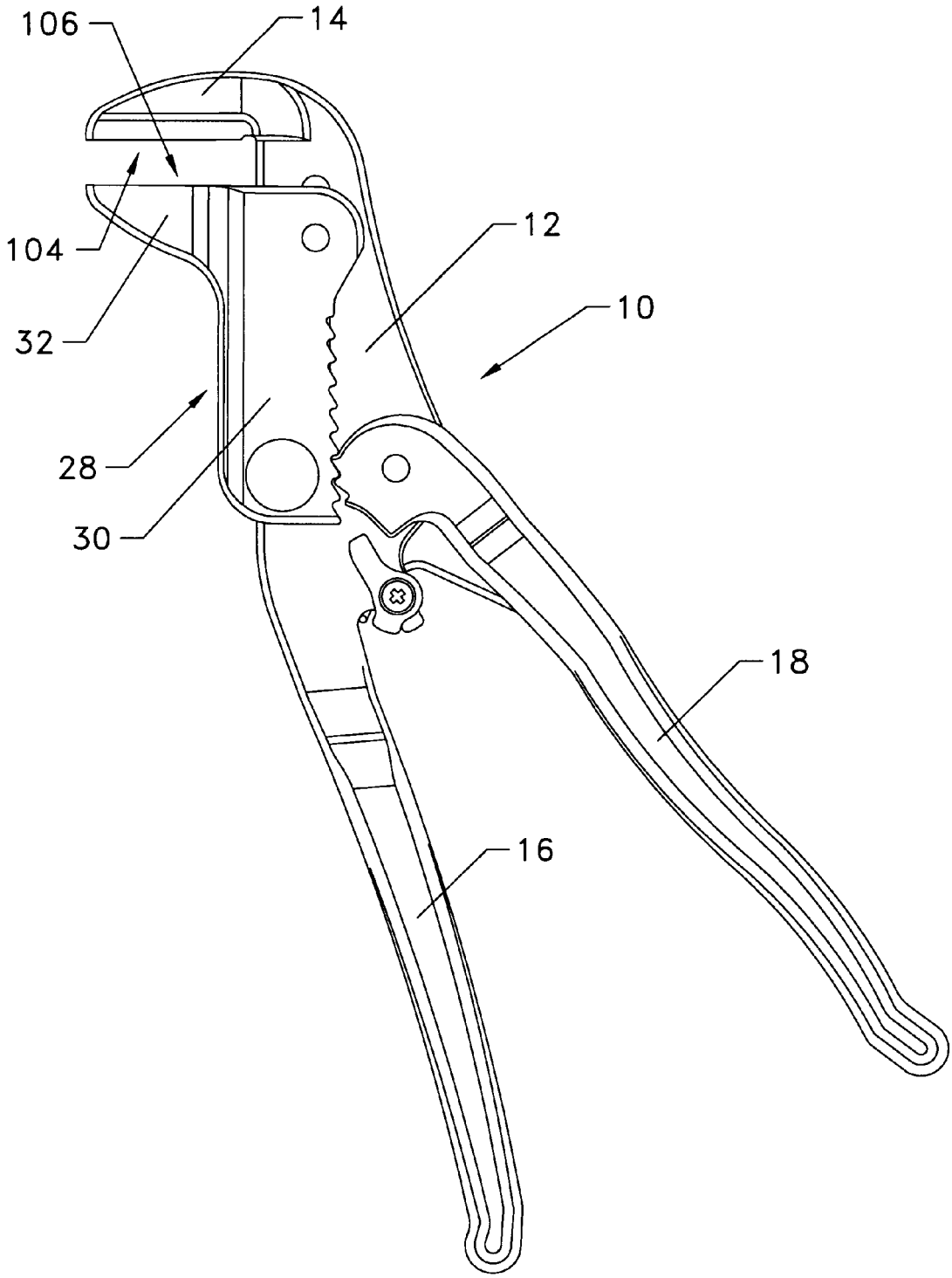
FIG. 7 is an assembled view in side elevation showing an alternative embodiment of the invention in the form of an adjustable wrench having jaws with smooth gripping surfaces.
Figure 8:
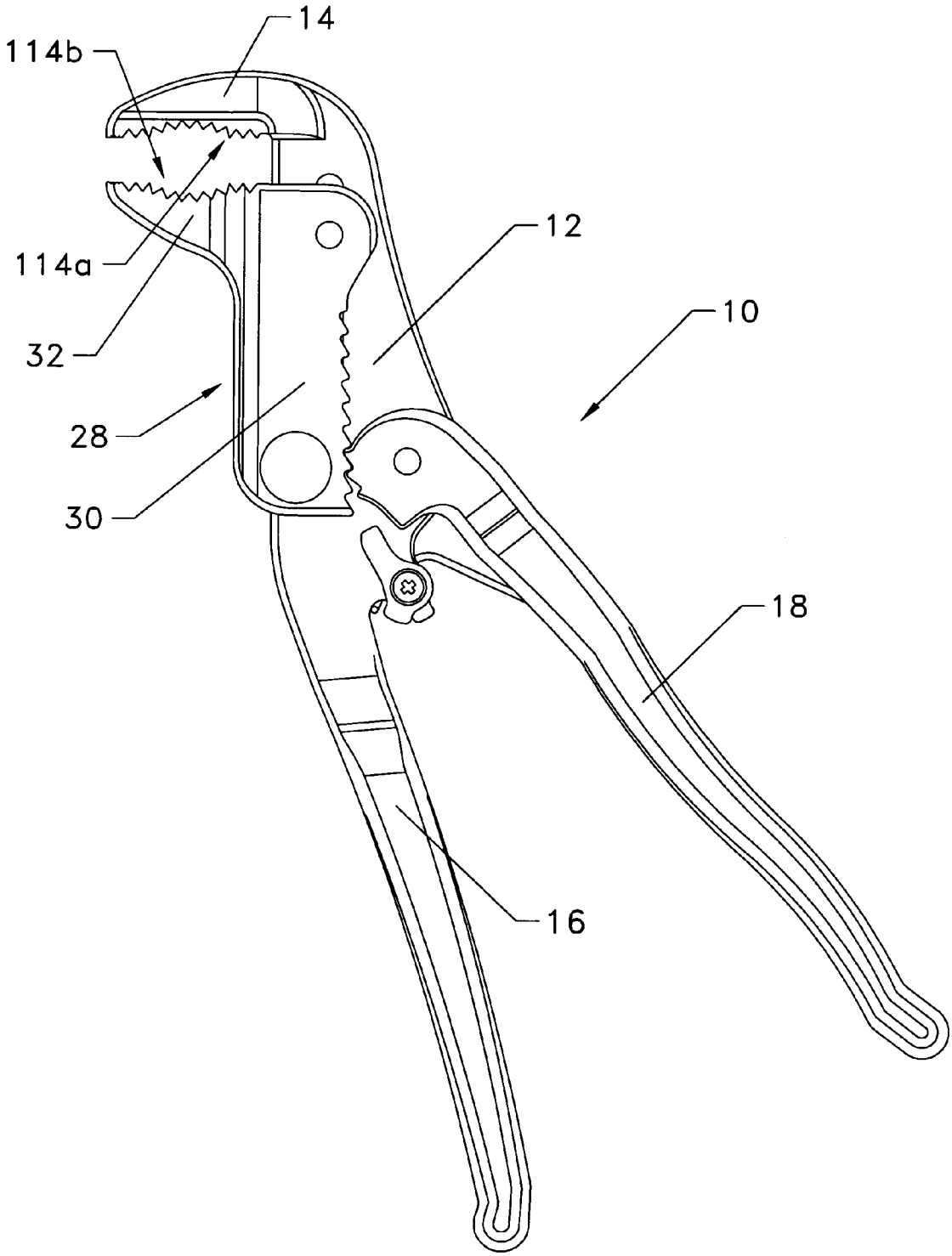
FIG. 8 is an assembled view in side elevation showing an alternative embodiment of the invention in form of an adjustable wrench having jaws with arcuately configured teeth for gripping cylindrical objects.
Figure 9:
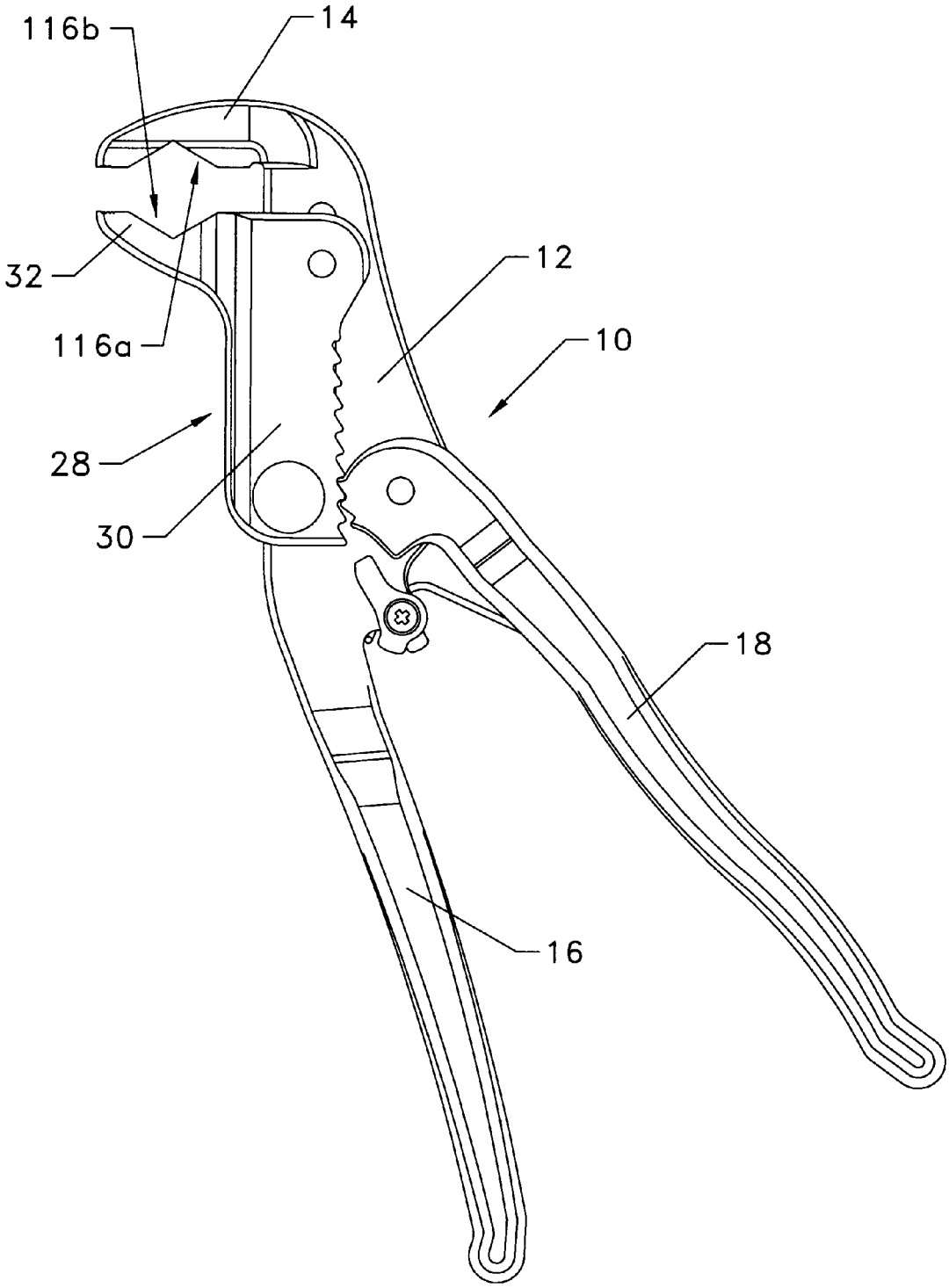
FIG. 9 is an assembled view in side elevation showing an alternative embodiment of the invention in the form of an adjustable wrench having jaws with opposing V-shaped gripping members.

Referring now to FIG. 7, an alternative embodiment of the invention is shown where gripping surfaces 104, 106 do not include gripping members such as teeth but, instead, are smooth. This embodiment is particularly suited for use in turning nuts and bolts. FIG. 8 shows another embodiment of the invention where gripping surfaces 104, 106 include a large set of teeth 114*a*, 114*b* arranged arcuately in jaws 14 and 32. This is embodiment is particularly suited to gripping pipes, pipe connections, or other cylindrical-shaped objects. Finally, FIG. 9 shows still another embodiment where gripping surfaces 104, 106 including opposing V's 116*a*, 116*b* with the corners having small radiused recesses to prevent the jaws from contacting the corners of hexagonal fittings, especially those made of materials that are softer than steel such as brass, copper, aluminum, and plastic. Those skilled in the art will appreciate that other jaw/gripping surface configurations could be employed for gripping objects of varied shapes.

It will be seen therefore, with reference to the foregoing description and drawings, that the present invention provides a number of improvements over the tool described in U.S. Pat. No. 5,408,904, including the following:

1. Handle (a) The pivot point of the handle has been moved closer to the gear teeth so as to increase the leverage applied by the apparatus to a work object.

(b) The handle return spring has been recessed to prevent damage and accumulation of dirt and other foreign objects. Alternatively, the spring can be located outside the handle assembly.

(c) The handle pin is larger and stronger.

(d) The degree of handle rotation has been physically limited to prevent the handle from pulling the handle return spring apart and so that the handle does not open too wide for the user to easily grasp.

2. Jaw (a) The gear teeth employ a conjugate involute design with radiused comers. The radiused edges decrease stress concentrations so as to increase tool life.

(b) The gear teeth are wider and stronger.

(c) The gear teeth are on the moveable jaw are positioned along an axis that is offset by approximately 1 to 4 degrees in relation to a line that is perpendicular to the axis along the jaw gripping surface to allow the jaw to operate easily even when the jaw is fully retracted and maintain the jaws in substantially parallel assignment when being closed.

(d) The jaw pin is larger and stronger.

(e) The jaw is narrower in front to allow access to confined areas.

(f) The jaw tensioning spring is stronger and recessed.

(g) Finger recessions are provided in the moveable jaw for easier gripping.

(h) Two sets of jaw gripping teeth are provided, a set of large teeth and a set of small teeth, with the large teeth being laterally offset by approximately 30% of the spacing between the teeth so as to grip objects securely while at the same time not cutting into the object as would occur if the teeth were opposing. Instead of cutting into the object, the teeth will only place bending stress on the object.

(i) The jaw tensioning spring is always centered in a small channel in the body.

3. Body (a) The fixed head may be positioned 90-degrees in relation to the longitudinal axis of the handle, or alternatively offset by approximately 0 to 45-degrees so that the head slides onto objects more easily.

(b) The beam on the body has been strengthened.

(c) The body head is narrower and smaller to allow access into tighter spots.

4. Handle Lock (a) Rotational limits are provided to keep the handle lock out of the way of other moving parts.

(b) The handle lock is slightly wider than the side of the handle to allow easier use.

5. Overall Improvements (a) Operation of the self-adjust mechanism has been improved.

(b) The overall weight of the tool has been reduced.

(c) Only three fasteners are required for assembly, thereby reducing manufacturing costs.

(d) The edges of the tool are rounded to reduce stress concentration and reduce injuries.

Accordingly, it will be seen that this invention provides a hand-operated tool that can quickly be adjusted to grip a work object. Although the description above contains many specificities, these should not be construed as limiting the scope of the invention but as merely providing illustrations of some of the presently preferred embodiments of this invention. Thus the appended claims and their legal equivalents should determine the scope of this invention.

What is claimed is:

1. A plier-wrench apparatus, comprising:

(a) a body, said body including a first handle, said body including a first jaw, said first jaw including a first gripping surface;

(b) a second handle, said second handle pivotally coupled to said body;

(c) a second jaw, said second jaw slidably and pivotally coupled to said body, said second jaw including a second gripping surface, said second jaw including a plurality of first gear teeth, said first gear teeth positioned along an axis that is canted toward said second gripping surface;

(d) a plurality of second gear teeth carried by said second handle, whereupon engagement of said second gear teeth of said second handle with said first gear teeth of said second jaw provides for adjusting said second jaw toward said first jaw; and (e) jaw opening means for adjusting said second jaw away from said first jaw.

2. An apparatus as recited in claim 1, wherein substantially parallel alignment between said first jaw and said second jaw is maintained during operation of said jaw closing means.

3. An apparatus as recited in claim 1, further comprising:

(a) a plurality of first gripping members associated with said first gripping surface; and (b) a plurality of second gripping members associated with said second gripping surface.

4. An apparatus as recited in claim 1, further comprising:

(a) a plurality of first spaced-apart teeth associated with said first gripping surface; and (b) a plurality of second spaced-apart teeth associated with said second gripping surface, wherein said second teeth are laterally offset from said first teeth by approximately thirty percent of the spacing between adjacent teeth in said first plurality of teeth.

5. An apparatus as recited in claim 1, wherein said first jaw and said first handle are longitudinally offset by approximately 0-degrees to approximately 45-degrees from a perpendicular orientation relative to the longitudinal axis of said first jaw.

6. An apparatus as recited in claim 1, further comprising:

(a) a bifurcated section on said second jaw providing two side walls and an inner wall;

(b) a rail section on said body, said rail section being at substantially a 90-degree angle relative to said first jaw, said bifurcated section on said second jaw straddling said rail section;

(c) an elongated slot in said body, said elongated slot being substantially parallel to said rail section; and (d) a pin coupled to said side walls of said bifurcated section and extending through said elongated slot.

7. An apparatus as recited in claim 1, further comprising:

(a) a spring having a first end attached to an inner wall of a bifurcated section on said second jaw and a second end bearing against a rail section on said body;

(b) said first gear teeth on said second jaw each having a long flat side and a short flat side cooperating with second gear teeth on said second handle;

(c) said second gear teeth on said second handle each having a long flat side and a short flat side cooperating with said first gear teeth on said second jaw; and (d) a spring disposed between said first handle and said second handle for urging said handles apart and assisting in the rapid opening and use of said handles to move said second jaw toward said first jaw and close said jaws on an object.

8. An apparatus as recited in claim 1, wherein said jaw opening means comprises at least one concave depression on said second jaw providing a finger gripping surface for pulling said second jaw outward and downward away from said first jaw.

9. A hand tool, comprising:

(a) a body, said body including an integrally formed fixed handle and an integrally formed fixed jaw, said fixed jaw including a first gripping surface;

(b) an adjustable jaw slidably and pivotally coupled to said body, said adjustable jaw including a second gripping surface, said adjustable jaw including a plurality of first gear teeth, said first gear teeth positioned along a longitudinal axis that is canted toward said second gripping surface;

(c) a jaw adjusting handle pivotally coupled to said body;

(d) a plurality of second gear teeth disposed on said jaw adjusting handle, whereupon engagement of said second gear teeth of said jaw adjusting handle and said first gear teeth of said adjustable jaw provides for adjusting said adjustable jaw toward said fixed jaw; and (e) jaw opening means for adjusting said adjustable jaw away from said fixed jaw.

10. A hand tool as recited in claim 9, wherein substantially parallel alignment between said fixed and said adjustable jaw is maintained during operation of said jaw closing means.

11. A hand tool as recited in claim 9, further comprising:

(a) a first plurality of teeth associated with said first gripping surface; and (b) a second plurality of teeth associated with said second gripping surface.

12. A hand tool as recited in claim 9, wherein said second plurality of teeth are laterally offset from said first plurality of teeth by approximately thirty percent of the spacing between adjacent teeth in said first plurality of teeth.

13. A hand tool as recited in claim 9, wherein said fixed jaw and said fixed handle are longitudinally offset by approximately 0-degrees to approximately 45-degrees from a perpendicular orientation relative to the longitudinal axis of said first jaw.

14. A hand tool as recited in claim 9, further comprising:

(a) a rail section formed on said body, said rail section positioned at substantially a 90-degree angle relative to said first gripping surface;

(b) an elongated slot in said body generally in substantially parallel alignment with said rail section;

(c) a bifurcated section on said adjustable jaw forming side walls and an inner wall; and (d) a retaining pin affixed to said side walls of said bifurcated section and inserted pivotally through said elongated slot in said body.

15. A hand tool as recited in claim 9, further comprising:

(a) a bifurcated section on said adjustable jaw providing two side walls and an inner wall;

(b) a rail section on said body, said rail section being at substantially a 90-degree angle relative to said fixed jaw, said bifurcated section on said adjustable jaw straddling said rail section;

(c) an elongated slot in said body, said elongated slot being substantially parallel to said rail section; and (d) a pin attached to said side walls of said bifurcated section and extending through said elongated slot.

16. A hand tool as recited in claim 9, further comprising:

(a) a spring having a first end attached to an inner wall of a bifurcated section on said adjustable jaw and a second end bearing against a rail section on said body;

(b) said first gear teeth on said adjustable jaw each having a long flat side and a short flat side cooperating with second gear teeth on said jaw adjusting handle;

(c) said second gear teeth on said jaw adjusting handle each having a long flat side and a short flat side cooperating with said first gear teeth on said adjustable jaw; and (d) a spring disposed between said fixed handle and said jaw adjusting handle for urging said handles apart and assisting in the rapid opening and use of said handles to move said adjustable jaw toward said fixed jaw and close said jaws on an object.

17. A hand tool as recited in claim 9, further comprising:

(a) a spring having a lower and an upper end, said lower end coupled to an inner wall of a bifurcation in said adjustable jaw;

(b) said first gear teeth on said adjustable jaw each having a long flat side and a short flat side joining at one end to form an angled tooth with a radiused edge; and (c) a plurality of second gear teeth formed on said jaw adjusting handle, each of said second gear teeth having a long flat side and a short flat side joining at one end to form an angled tooth with a radiused edge, said second gear teeth cooperating with said first gear teeth on said adjustable jaw to slide said adjustable jaw toward said fixed jaw as said jaw adjusting handle is pivoted back and forth away from and toward said fixed handle;

(d) said spring being curved so that said upper end bears against a rail section on said body and holds an upper portion of said second jaw away from said rail section and urges said first gear teeth on said second jaw toward second gear teeth on said second handle into engagement.

18. A hand tool as recited in claim 9, wherein said jaw opening means comprises concave recesses on opposite sides of said adjustable jaw that may be gripped to pull a bottom portion of said adjustable jaw away from a rail section on said body and separate said first gear teeth on said adjustable jaw from second gear teeth on said jaw adjusting handle so that said adjustable jaw may be pulled away from said fixed jaw in one continuous motion.

19. A hand tool as recited in claim 9, wherein said jaw opening means comprises at least one concave depression on said adjustable jaw providing a finger gripping surface for pulling said adjustable jaw outward and downward away from said fixed jaw.

20. A hand tool, comprising:

(a) a body, said body including an integrally formed fixed handle and an integrally formed fixed jaw, said fixed jaw including a first gripping surface;

(b) a rail section formed on said body, said rail section being at substantially a 90-degree angle relative to said fixed jaw;

(c) an elongated slot in said body generally in parallel alignment with said rail section;

(d) an adjustable jaw;

(e) a bifurcated section on said adjustable jaw having side walls and an inner wall, said bifurcated section straddling said rail section;

(f) a fastener affixed to said side walls of said bifurcated section and inserted through said elongated slot, wherein said adjustable jaw is slidably and pivotally coupled to said body;

(g) a plurality of first gear teeth formed on said adjustable jaw, each of said first gear teeth having a long flat side and a short flat side joining at one end to form an angled tooth with a radiused edge, said first gear teeth positioned along an axis that is canted toward said second gripping surface;

(h) a jaw adjusting handle pivotally coupled to said body;

(i) a plurality of second gear teeth formed on said jaw adjusting handle, each of said second gear teeth having a long flat side and a short flat side joining at one end to form an angled tooth with a radiused edge, said second gear teeth cooperating with said first gear teeth on said adjustable jaw to slide said adjustable jaw toward said fixed jaw as said jaw adjusting handle is pivoted back and forth away from and toward said fixed handle, wherein substantially parallel alignment between said fixed jaw and said adjustable jaw is maintained during operation of said jaw adjusting handle;

(j) a spring having a lower and an upper end, said lower end coupled to said inner wall of said bifurcated section in said adjustable jaw, said spring being curved so that said upper end bears against said rail section and holds an upper portion of said second jaw away from said rail section and urges said first gear teeth on said second jaw toward second gear teeth on said jaw adjusting handle into engagement; and (k) at least one concave recess on said adjustable jaw that may be gripped to pull said bottom portion of said adjustable jaw away from said rail section on said body and separate said first gear teeth on said adjustable jaw from said second gear teeth on said jaw adjusting handle so that said adjustable jaw may be pulled away from said fixed jaw in one continuous motion.

* * * * *